US005596936A

United States Patent [19]

Bullock et al.

[11] Patent Number: 5,596,936

[45] Date of Patent: Jan. 28, 1997

[54] RAIL CAR BRIDGE PLATE

[75] Inventors: Robert L. Bullock; Bruce M. Bullock, both of Antioch, Ill.

[73] Assignee: Standard Car Truck Company, Park Ridge, Ill.

[21] Appl. No.: 514,414

[22] Filed: Aug. 11, 1995

Related U.S. Application Data

[63] Continuation of Ser. No. 192,055, Feb. 4, 1994, which is a continuation-in-part of Ser. No. 161,755, Dec. 3, 1993, abandoned.

[51] Int. Cl.[6] ..... B61D 49/00

[52] U.S. Cl. ..... 105/458

[58] Field of Search ..... 105/396, 422, 105/425, 436, 457, 458, 459, 460, 401; 296/50, 51, 52, 53, 55, 56, 57.1, 59, 61

[56] References Cited

U.S. PATENT DOCUMENTS

| | | |
|---|---|---|
| 66,419 | 7/1867 | Traxler . |
| 68,327 | 8/1867 | Wilcox . |
| 84,808 | 12/1868 | Elder . |
| 2,052,867 | 9/1936 | Cartzdafner et al. . |
| 2,788,751 | 6/1957 | Russell . |
| 3,001,266 | 9/1961 | Kilbane et al. . |
| 3,195,478 | 7/1965 | Thompson . |
| 3,203,364 | 8/1965 | Gutridge . |
| 3,323,472 | 6/1967 | Boone et al. . |
| 3,370,552 | 2/1968 | de Podesta et al. . |
| 3,421,454 | 1/1969 | Connerat . |
| 3,572,254 | 3/1971 | Slager . |
| 4,721,426 | 1/1988 | Bell et al. . |
| 5,004,287 | 4/1991 | Doyle . |
| 5,010,614 | 4/1991 | Braemert et al. . |
| 5,244,335 | 9/1993 | Johns . |
| 5,312,149 | 5/1994 | Boone . |

FOREIGN PATENT DOCUMENTS

| | | |
|---|---|---|
| 9162 | 3/1902 | Australia . |
| 539581 | 11/1931 | Germany . |
| 806859 | 6/1951 | Germany . |
| 947078 | 7/1956 | Germany . |
| 5139295 | 6/1993 | Japan . |
| 37273 | 1/1914 | Sweden . |

*Primary Examiner*—Mark T. Le

*Attorney, Agent, or Firm*—Dorn, McEachran, Jambor & Keating

[57] ABSTRACT

A bridge plate assembly for use in moving vehicles between rail cars for loading and unloading has sufficient length to span the space between adjacent rail cars and has sufficient width to accommodate vehicles of varying wheelbase. The plate assembly includes two relatively movable telescoping load bearing members, each of which includes a plurality of spaced tubular members and a support member at each end of each plate member joining the tubular members together.

10 Claims, 3 Drawing Sheets

RAIL CAR BRIDGE PLATE

This application is a continuation of application Ser. No. 08/192,055, filed on Feb. 04, 1994, which is a continuation-in-part of application Ser. No. 08/161,755, filed on Dec. 3, 1993, now abandoned.

THE FIELD OF THE INVENTION

The present practice in loading automotive type motor vehicles including light trucks, vans, and sport utility vehicles onto railroad multi-level auto rack freight cars (freight cars) for shipment by rail is to drive the motor vehicle onto one end of a string of freight cars coupled together. The motor vehicles are driven into the first freight car on either the first, second, or third deck, depending upon the type and size of multi-level auto rack freight car, with the gap between the adjoining decks of adjacent freight cars being spanned by a pair of portable bridge plates. Each pair of bridge plates supports the motor vehicle as it is driven over the gap between the decks of adjacent freight cars with one plate supporting the right side and the other the left side of the motor vehicle. Conventionally, the portable bridge plates are mounted to the freight cars only during loading and unloading of the motor vehicles. The Association of American Railroads (AAR) specifies a maximum weight of 40 lbs. and a minimum strength requirement of 4500 lbs. and a fatigue load of 1500 lbs. for portable bridge plates in AAR Specification M-951. Conventionally, portable bridge plates are made of aluminum plate with a steel hinge and weigh between 37 and 40 lbs., but nevertheless, they are still difficult for both male and female employees (workmen) to handle during installation and/or removal and often are the cause of personal injury, as well as damage to the plate itself. Conventionally, the portable bridge plates are pivotally attached to one end of one freight car and span the gap to the deck of the adjacent freight car. The portable bridge plates are only attached to a freight car at one end so as to accommodate variable spacing between adjacent coupled freight cars in the string that have been spotted for loading and/or unloading. Pivotal attachment is by a spring-biased latch which has limited accessibility as the latch can only be accessed from the bottom of the bridge plate, again making the job of the workmen more difficult during installation and removal at certain deck positions.

A further problem with the present type of portable bridge plate is that its size is not sufficient to accommodate recent and future changes to motor vehicle and freight car designs. The problem with the present type of portable bridge plate is that its width is not sufficient to accommodate motor vehicles with narrow tracks now being used on some sub-compact and future motor vehicle designs. These motor vehicles' lateral wheel spacing is too narrow and cannot properly span the distance between the pair of portable bridge plates. Without extreme care, these motor vehicles may fall between the bridge plates spanning the gap between adjacent freight cars. Some motor vehicle manufacturers have advised that this track dimension will be reduced even further in the future.

A further problem with the present portable bridge plate is that it cannot accommodate a recent increase in the gap between adjacent freight cars. AAR Specification M-921D relative to freight car draft gear requires all freight cars to be modified over the next four years. The new specification requires a 50,000 lb. pre-load to be built into each freight car draft gear to reduce in-train longitudinal forces. The old specification had no pre-load and the freight cars could be easily bunched together to accommodate the present bridge plate design. Now with the required pre-load, the freight cars cannot be bunched as close together and the present portable bridge plate is too short to properly span the gap between adjacent freight car decks. No longer will it be possible to set the hand brake at one end of a string of freight cars being positioned for loading or unloading of motor vehicles and then compress the freight cars together by applying force from an engine at the opposite end. The pre-load required by AAR Specification M-921D will not allow the draft gears to compress (the end freight car wheels will slide on the rail with the hand brake set) allowing the space between freight cars to be reduced using this compressing method with the result that the current portable bridge plate will not be able to properly span the gap between the decks of adjacent freight cars. To make the portable bridge plates of the current design wider and longer and meet the AAR minimum loading requirements would cause the plates to weigh more than the AAR mandated 40 lbs. maximum.

A further problem with the present type of portable bridge plate is that the non-pivotally attached end of the plate rests on the adjacent freight car deck. However, because of the variable gap between adjacent freight cars and the several designs of different manufacturers of auto racks, the bridge plate often rests upon obstructions such as door locks, chain rails and chock rails. When the plate rests upon these obstructions the vertical height for the motor vehicle is reduced leading to roof damage of the vehicle and the end of the bridge plate presents a sharp metal edge that can damage the motor vehicle rubber tires.

A further problem with the present type of portable bridge plate is that its top surface is painted with an antiskid paint to provide traction and a bright safety color as the motor vehicle is driven across. This paint wears off with usage and is a high maintenance item. Also, the shape of the present plate allows it to collect water, snow and ice which reduces traction and often falls on the workmen during removal.

An additional problem with the present portable bridge plate is that the top and bottom are not reversible, requiring the workman to pick it up in the proper orientation to install it on the freight car or set it down and reorient his handhold. This is not always easy to accomplish since the workman may be as high as fourteen feet above the rails. A further problem with the present portable bridge plate is that it does not have a handhold at the non-locking end.

The present invention provides a lightweight, easily handled, reversible portable bridge plate assembly which has sufficient width to handle narrow track motor vehicles and is variable in length to span any reasonable gap between decks of adjacent freight cars and will not rest on floor obstructions that would cause motor vehicle damage. The maximum weight of the reversible bridge plate assembly shown herein is considerably less than the 40 lb. maximum specified by the AAR. It is formed of a pair of telescoping panel members, each of which comprises a series of spaced parallel extruded aluminum tubes joined together by transversely extending support members at the ends. Each panel member is pivotally attached to one end of a freight car with a spring-biased latch which is accessible from either the top or bottom through a hand opening used by the workmen to move and orient the portable bridge plate during installation and removal.

SUMMARY OF THE INVENTION

The present invention relates to portable bridge plates for use in loading and unloading automotive type motor vehicles onto and off of freight cars and particularly relates to a lightweight, easily installed and removed portable bridge plate assembly in which each of the panel members is formed of a plurality of spaced parallel tubular members joined together at their ends by transversely extending support elements.

Another purpose of the invention is a portable bridge plate assembly which weighs substantially less than the AAR maximum weight limitation of 40 lbs., meets the AAR minimum strength requirements, has sufficient width to be useful with all automotive-type motor vehicle designs, including narrow tracked motor vehicles, and has adequate length to span the gap between the decks of adjacent freight cars.

Another purpose of the invention is a portable bridge plate assembly that has adjustable length to span the variable gap between decks of adjacent freight cars by using a pair of telescoping panel members, each of which is pivotally attached to an end of adjoining freight cars.

Another purpose of the invention is a portable bridge plate that has a hand-hold at each end to improve the ease of handling by the workmen.

Another purpose of the invention is a portable bridge plate wherein the spring-biased locking mechanism of the pivot is accessible from both the top and bottom of the bridge plate.

Another purpose of the invention is a portable bridge plate that is reversible for ease of use by the workmen.

Another purpose of the invention is a portable bridge plate that clears all floor obstructions of various freight car deck designs, thus providing maximum motor vehicle vertical clearance.

Another purpose of the invention is a portable bridge plate that has reinforcing ribs on portions thereof, which reinforcements provide maximum traction for a motor vehicle moving thereacross.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
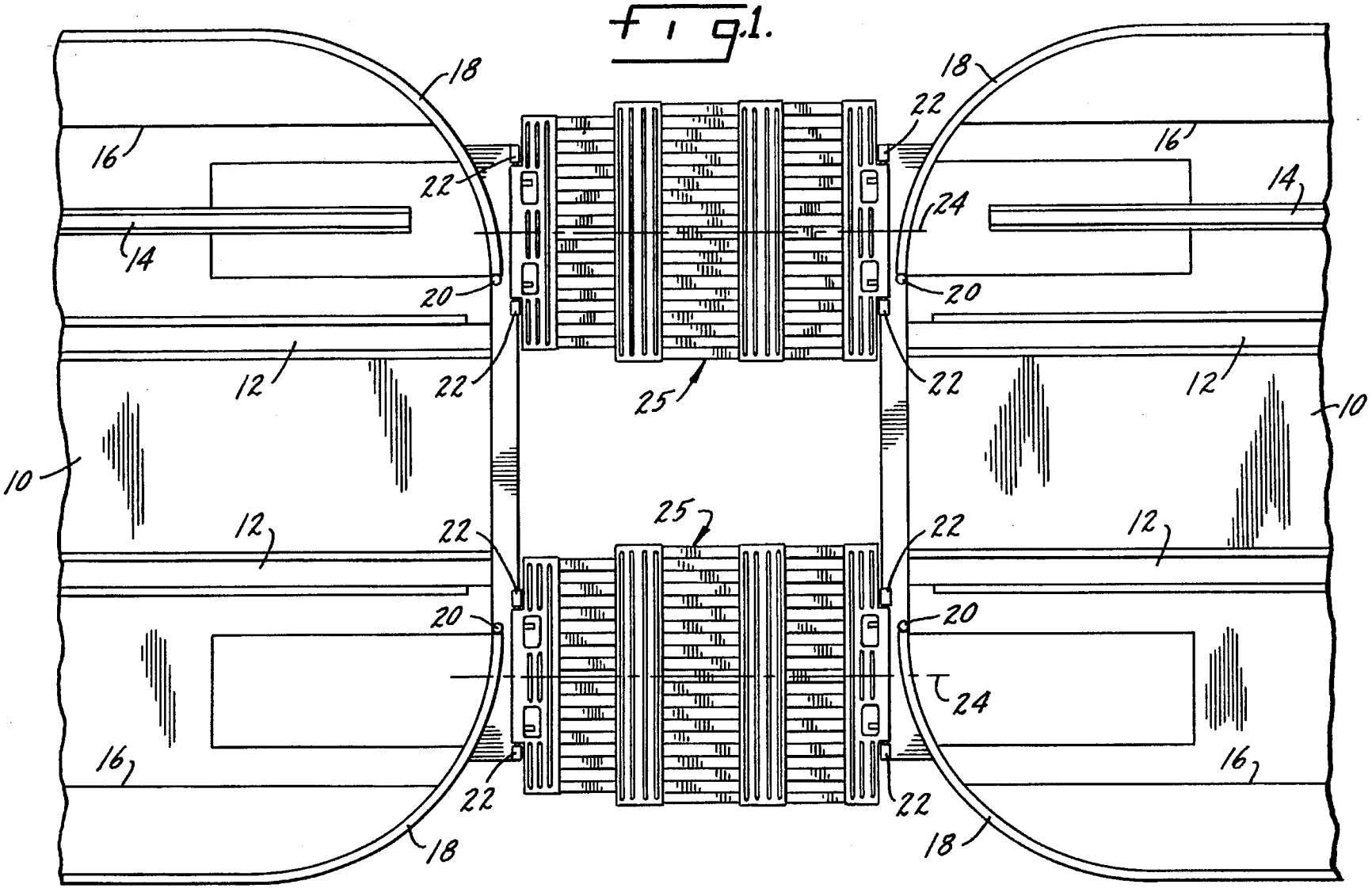
FIG. 1 is a top plan view of the adjoining ends of rail cars showing the bridge plate assembly of the present invention in position.

In the drawings, one end of a typical rail car for use in transporting automotive type vehicles has a floor 10 with spaced chain rails 12. Outboard of one of the chain rails 12 is a wheel chock track 14. One set of the vehicle wheels will pass between the chock track 14 and the chain rail 12, with the vehicle being chained to the chain rail and chocks being used to restrain the vehicle wheels. The interior walls of the rail car are indicated at 16, and as is conventional, there are arcuate doors at each end, with the track for the doors being shown at 18 and the door stops being indicated at 20. At each end of the car, there are barrel rings 22, there being a pair of such rings for each bridge plate assembly, with the centerline 24 of each bridge plate assembly being intermediate the barrel rings. Each bridge plate assembly must be sufficient in width to accommodate both wide track and narrow track vehicles and in fact automotive type vehicles of almost any wheelbase which can fit within the confines of the multideck rail car.

Each bridge plate assembly 25 includes a pair of telescoping plate members which, as shown in the drawings, may be designated as a right-hand plate member 26 and a left-hand plate member 28. The right-hand plate member 26 is made up of a plurality of spaced parallel hollow square aluminum tubes, which may for example be 1½"×1½" with a wall thickness of from 0.06" to 0.08". The tubes are indicated at 30 and may be spaced apart a distance which is equal to the width of the tubes. The tubes in the right-hand plate member 26 are joined together by a transversely extending support member 32 which may also be formed of extruded aluminum, or it may be formed of some other material, and will be suitably attached to the tubes 30. Mechanical fasteners, welding, or other means may be satisfactory. The top and bottom surfaces of the support member 32 may have a series of spaced transversely extending ribs 34 which both strengthen the support members and provide a means for increased traction of the vehicle moving across the bridge plate assembly. The outboard end of right-hand plate member 26 has an end connector 36 which again may be formed of aluminum or some other satisfactory material and also has reinforcing and traction ribs 38 along the upper and lower surfaces thereof. The end plate connector 36 has hand openings 40, as will be described hereafter.

The left-hand plate member 28 is formed in the same manner as plate member 26 and has a plurality of parallel aluminum tubes 42 which are joined together at their opposite ends by a support member 44 and an end connector 46. Again, there are hand openings 48 for use in installing and removing the bridge plate assembly.

The right-hand and left-hand plate members are telescopically movable to provide a bridge plate assembly of adjustable length. It should be noted that the aluminum tubes 30 and 42 interfit since the spacing between tubes is equal to the width of the tubes. The plate members have substantial strength even though the entire assembly is considerably less in weight than the AAR 40 lb. maximum. The described telescopic interconnection permits a minimum distance between the pivotal hinge connections of about 46" and a maximum distance between the hinge connections up to about 56". This is consistent with the distance between rail cars presently in use.

Figure 2:
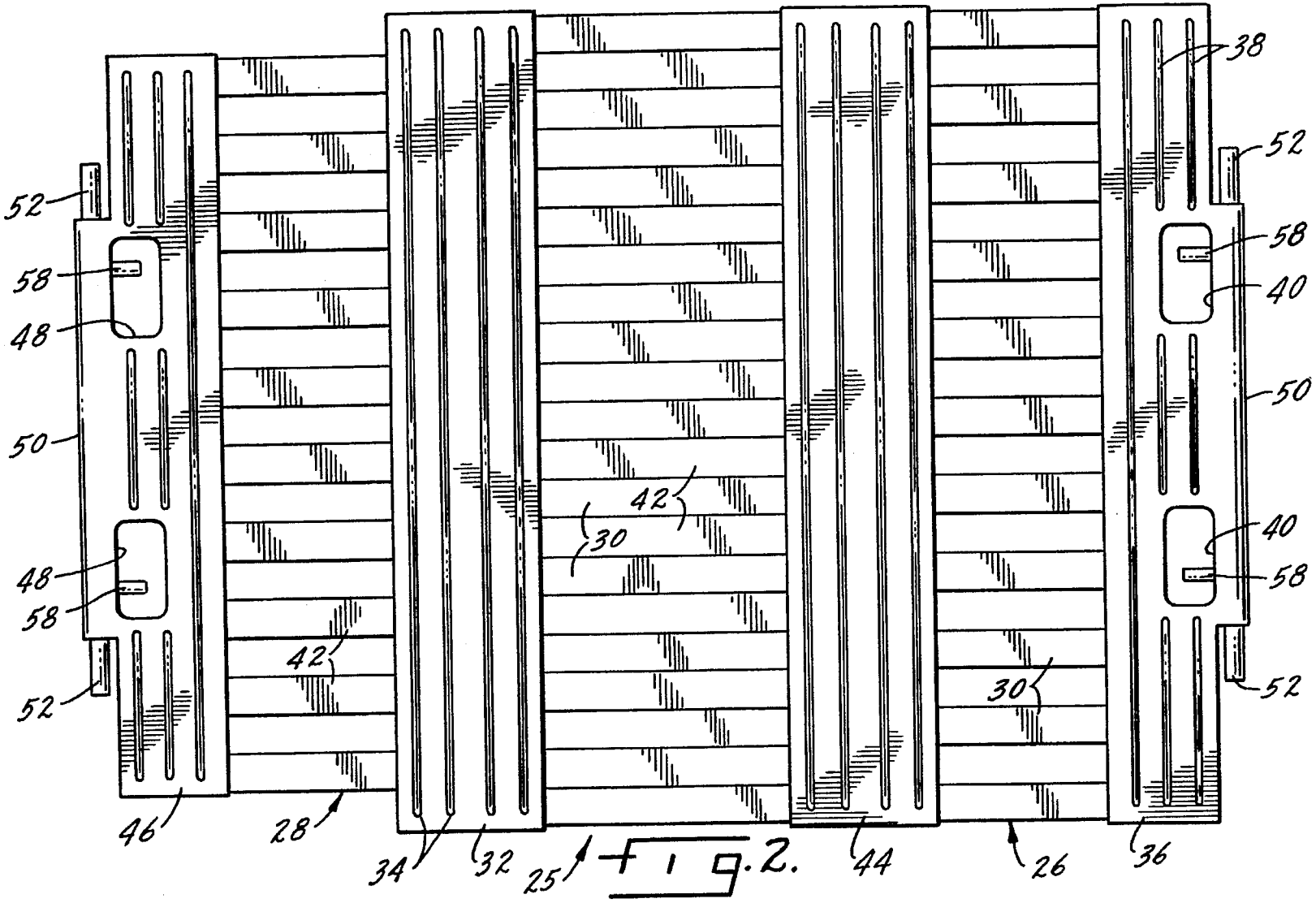
FIG. 2 is an enlarged top view of the bridge plate assembly.
Figures 3, 4, 5, 6:
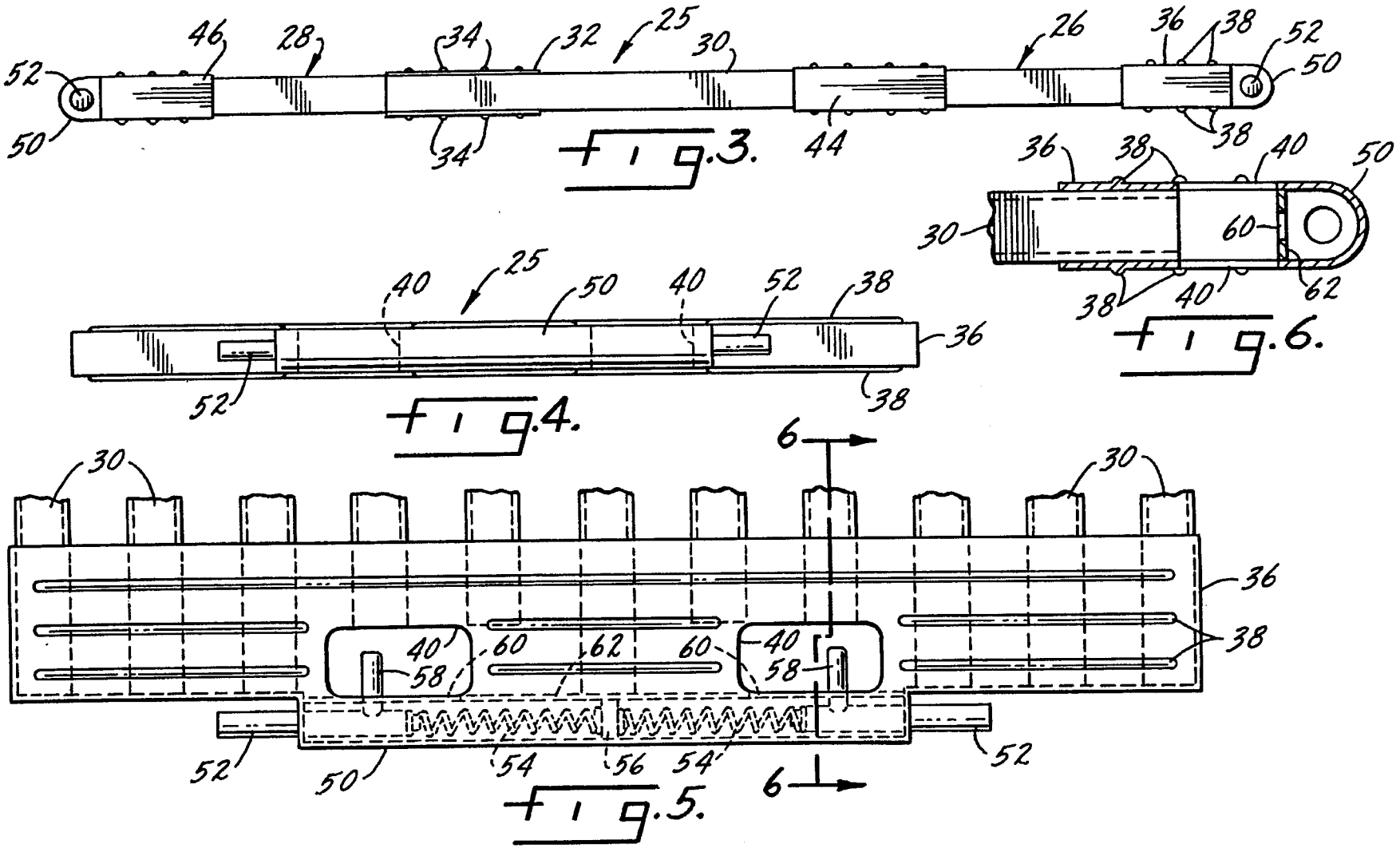
FIG. 3 is a side view of the bridge plate assembly.
FIG. 4 is an end view of the bridge plate assembly.
FIG. 5 is an enlarged partial top view of the end plate connector.
FIG. 6 is a vertical section through the end plate connector with the pin removed, taken on line 6—6 of FIG. 5.

As indicated in the top plan view of the rail car, there are two barrel rings for attaching each bridge plate assembly. The end connector of each plate member which will form the pivotal attachment with the barrel ring has an integral sleeve 50 from which extend sliding pins 52, each of which will extend into one of the barrel rings during mounting of the bridge plate assembly. The pins 52 are biased in an outward direction by return springs 54 which bottom on a support 56 in the sleeve 50. Each pin 52 has a pin handle 58 attached thereto which extends through a slot 60 in a plate 62. Handles 58 are used to retract the pins during mounting. As particularly shown in FIG. 2, the pin handles are accessible to a workman from either above or below the plate assembly through one of the openings 40 in the ends of the plate members adjacent the hinge connection. The openings not only provide easy access to the pin handles, but also provide a hand-hold where the workman may grasp the assembly with ease during installation. This is to be contrasted with the present bridge plates which are extremely difficult to handle, both because of the weight and because of the lack of any readily accessible hand gripping area.

In mounting the bridge plate assembly, a workman will connect one end of the assembly with one end of a rail car by first retracting the pins, aligning the pins with the barrel rings, and then releasing the pin handles so that the pins will be driven into the barrel rings by the return springs. The two plates are moved relative to each other until the opposite end of the bridge plate assembly is in position for attachment to the adjoining car in the same manner.

As indicated earlier, the AAR has a maximum weight for bridge plates of 40 lbs. Present-day bridge plates are not adequate to span the distance between adjoining rail cars with the new AAR draft gear requirements, nor do they have sufficient width to accommodate narrow track vehicles. The need is for a lightweight, weather resistant bridge plate assembly which is compatible to the current fleet of rail cars, capable of supporting motor vehicles weighing up to approximately 6,000 lbs., and which will span a maximum distance between cars of up to 56". The present invention provides a bridge plate assembly utilizing a pair of plate members, each of which is light in weight and made from relatively inexpensive aluminum tubes joined together at their opposite ends with the plates being telescoped together. The maximum weight may vary, depending upon the specific type of tube, but normally will be no greater than about 30 lbs.

Whereas the preferred form of the invention has been shown and described herein, it should be realized that there may be many modifications, substitutions and alterations thereto.

The embodiments of the invention in which an exclusive property or privilege is claimed are defined as follows:

1. A portable bridge plate assembly attachable to and removable from facing ends of rail cars for use in moving vehicles between stationary rail cars for loading and unloading, said plate assembly having a maximum weight of 40 lbs., a minimum strength requirement of 4500 lbs., and a fatigue load of 1500 lbs., said plate assembly having sufficient length to span the space between adjacent rail cars, having sufficient width to accommodate vehicles of varying wheelbase and having sufficient strength to support a vehicle, said plate assembly including two relatively movable telescoping load bearing plate members, said plate members being relatively movable to accommodate variant spacing between the facing ends of stationary rail cars, said plate members being secured together to permit relative movement only in a direction parallel to the plate assembly, each said plate member including a plurality of spaced tubular members, an end connector at the outboard end of each said plate member, a spring-biased latch for securing each said plate member to the end of a rail car, each of said end connectors including a hand opening in the end thereof adjacent the spring-biased latch, each said spring-biased latch having an operating handle accessible through said hand openings.

2. The bridge plate assembly of claim 1 characterized in that said tubular member have a rectangular cross section.

3. The bridge plate assembly of claim 1 characterized in that the tubular members of one plate member are positioned intermediate the tubular members of the other plate member.

4. The bridge plate assembly of claim 3 characterized in that said tubular members are all in the same plane.

5. The bridge plate assembly of claim 1 characterized in that each of said end connectors has an outer surface with reinforcing ribs thereon.

6. A bridge plate assembly for use in moving vehicles between rail cars for loading and unloading, said plate assembly having sufficient length to span the space between adjacent rail cars and having sufficient width to accommodate vehicles of varying wheelbase, said assembly including a plate member having a plurality of spaced tubular members joined by a transverse support member, said transverse support member having a hand opening therein, and a spring-biased latch for attaching the plate member to an end of a rail car, with said spring-biased latch being accessible through said opening.

7. The bridge plate assembly of claim 6 characterized in that each of said tubular members is hollow and is rectangular in cross section.

8. The bridge plate assembly of claim 7 characterized in that the outer surface of said transverse support member includes reinforcing means thereon.

9. The bridge plate assembly of claim 6 characterized in that said spaced tubular members extend in the direction in which vehicles will be moved across said plate assembly in loading and unloading rail cars.

10. The bridge plate assembly of claim 6 characterized by and including a second plate member formed of a plurality of spaced tubular members joined at opposite ends thereof by transverse support members, said plate members being telescopically relatively movable whereby said assembly is adjustable as to length to span a variable gap between adjacent rail cars.

* * * * *